United States Patent [19]

Anderson et al.

[11] 4,430,178

[45] Feb. 7, 1984

[54] METHOD AND APPARATUS FOR EFFECTING CURRENT REVERSAL IN ELECTRO-DEPOSITION OF METALS

[75] Inventors: Harold J. T. Anderson, Oakville; Robert C. Kerby, Rossland; Clifford J. Krauss, Trail; Hubert W. Neame, Mississauga, all of Canada

[73] Assignee: Cominco Ltd.

[21] Appl. No.: 381,725

[22] Filed: May 24, 1982

[51] Int. Cl.[3] ..... C25C 1/18

[52] U.S. Cl. ..... 204/114; 204/117; 204/228; 204/DIG. 9; 323/247

[58] Field of Search ..... 204/117, 114, 228, DIG. 9; 323/44 R

[56] References Cited

U.S. PATENT DOCUMENTS 4,024,035 6/1977 Enchev et al. ..... 204/228

4,105,527 8/1978 Enchev et al. ..... 204/228

*Primary Examiner*—R. L. Andrews

*Attorney, Agent, or Firm*—Wenderoth, Lind & Ponack

[57] ABSTRACT

A method and apparatus for effecting periodic current reversal in metal electro-deposition processes are disclosed. By using a circuit in which the current always flows in the same direction through a filter reactor, regardless of the current flow through the electro-deposition cell, faster reversal switching times are obtained. The overshoot and AC ripple encountered on current reversal are also decreased.

18 Claims, 4 Drawing Figures

METHOD AND APPARATUS FOR EFFECTING CURRENT REVERSAL IN ELECTRO-DEPOSITION OF METALS

BACKGROUND OF THE INVENTION

1. Field of the Invention

This invention relates to the electro-deposition of metals and, more particularly, to a method and apparatus for periodically reversing the current in the electro-deposition of metals.

2. Description of the Prior Art

Periodic current reversal has been used to advantage in electrodeposition processes for metals. These processes include the electrowinning, electrorefining and electroplating of such metals as, for example, copper, nickel, zinc, silver, tin, lead, cadmium, gold, platinum and indium, as well as other metals.

In periodic current reversal, the polarity of the current supplied to the electrodes is reversed for short periods of time during the electrodeposition cycle. When the current is in the forward mode, metal deposits on the desired electrode. When the current is in the reverse mode, deplating of deposited metal occurs. The length of the period during which the current is in the reverse mode is shorter than the length of the period during which the current is in the forward mode. Usually, the period for the reverse mode is from 1/100 to 1/10 of the period for the forward mode, although lower as well as higher fractions have been used. The frequency of the reversals usually ranges from 2 to 50 reversals per minute.

The use of periodic current reversal in electro-deposition of metals is disclosed in U.S. Pat. Nos. 1,534,709, 1,956,411, 2,119,936, 2,216,167, 2,451,340, 2,451,341, 2,678,909, 2,951,978, 3,755,113, 3,799,850, 3,864,227, 4,024,035, 4,105,517 and 4,140,596.

Many systems for effecting periodic current reversal are known. One such system employs a common control block, which is connected to a group of electrolytic cells, with a controllable thyristor current rectifier for forward current and a mains-guided inverter that returns energy to the power system for reverse current. A drawback of this system is that only either the rectifier or the inverter is operating at any one time, so that the total system capability is not fully utilized. Moreover, the use of the inverter is subject to losses.

In another system, a current rectifier is used which is switched off during the period of reverse current, the cells are short-circuited and the reverse current passes only because of the energy stored in the cells. Because of the short-circuit currents, an effective control of the process is impossible In yet another system, as disclosed in U.S. Pat. Nos. 4,024,035 (which issued on May 17, 1977) and 4,105,527 (which issued on Aug. 8, 1978) a reversable electric current of different duration is employed in two groups of cells. The reverse current in one group is supplied by the forward current in the second group. The system comprises a first controllable rectifier, a second controllable rectifier, each rectifier being connected to a group of cells through a common diode switch, and a control block. Both groups of cells and rectifiers are connected in series and in opposite directions with respect to each other. The common diode switch is connected between the common points of the cells and rectifiers. The rectifiers are switched off to dampen the transition processes in the system before the polarity of the current is reversed. Disadvantages of this system are the expense of interconnecting two cell groups, and the interdependence of two cell groups. This requires a shut-down of both groups, when a failure occurs for any reason in either the control block, or in either one of the controllable rectifiers.

Although many advantages can be realized from using periodic current reversal, there are disadvantages. The main disadvantages are: the reductions in the utilization of current during an electro-deposition cycle wherein a forward, or depositon, current and a reverse, or dissolution, current are used. The reductions in current utilization occur for the periods of time during which the forward current is shut off, and the reverse current is applied; for the periods of time needed for redeposition of dissolved metal; and for the periods of time required for effecting the reversal of the polarity of the current from forward to reverse, and from reverse to forward. Other disadvantages are the presence of AC ripple in the DC applied to the cells, and current overshoot upon current reversal.

The current utilization, C.U., for an electro-depostion cycle may be defined as the ratio between the net current required to obtain the metal deposit during a refining cycle, and the gross current required to obtain the same deposit without current reversal. The C.U. may be expressed approximately as follows:

$$C.U. = \frac{i_F t_T - n \cdot i_F t_R - n \cdot i_R t_R - n[i_F t_{FS} + 2 i_F t_D + 2 i_F t_{RS} + i_R t_{RS}]}{i_F t_T}$$

wherein:

$i_F$=forward current $t_T$=total electro-deposition cycle time $i_R$=reverse current $t_R$=reverse time $t_{FS}$=forward switching time $t_{RS}$=reverse switching time $t_D$="dead" time n=number of reversals during one electro-deposition cycle The switching time $t_s$ from full forward to full reverse current or vice versa equals $t_{FS}+t_D+t_{RS}$, the total switching time for one reversal being twice this sum.

The efficiency of the electro-deposition process is directly dependent on the current utilization and any increase in utilization will increase the process efficiency. As the forward current and the reverse current and the forward time and the reverse time as well as the total cycle time usually have fixed values, in order to realize process objectives, only a reduction in switching time will lead to increased current utilization.

In conventional methods for periodic current reversal, the time required for each reversal of current polarity is in the order of 30 to 300 ms (milli seconds), even when using electronic switching. These relatively long switching times are caused by the need to wait until the current comes to zero after switching off the forward current before the reverse current can be switched on. For a given installation, this time is generally constant and is not related to the frequency of reversal. Of course, the higher the frequency of reversals is for an electro-deposition cycle, the higher are the cumulative switching losses, since the switching loss equals the switching time, which is roughly constant, multiplied by the number of times reversal is effected during the electro-deposition cycle time.

Another disadvantage of the prior art processes is the lack of control of AC ripple in the rectified electrical current. The ripple on the DC causes, in many cases, rough growth of depositing metal and dissolution of impurities from the anodes. In processes where a varying current may be used, such as for example, in certain applications of the electrorefining of lead, the harmful effects of ripple increase at lower current values. A third disadvantage is the occurrence of overshoot when the polarity of the current is reversed. Current overshoot has the same deleterious effects as current ripple and should therefore, also be kept as low as possible.

A short reversing or switching time could be instituted by conventional means which, however, would involve the use of a considerable excess transformer voltage which is required to force the current to reverse. This would result in low power factors and expensive transformers, and increased current ripple.

Although the use of a combination of an inductor and a capacitor for filtering the rectified current would alleviate problems associated with AC ripple, the use of a capacitor on a reversing rectifier is also troublesome, because it takes time to reverse the voltage on the capacitor. A high loop gain is required in order to get a fast response in switching when the current polarity is reversed. Low ripple with relatively fast response could be obtained with a 12 or 24 pulse system but the large number of parts and increased complexity of such a system would reduce its reliability and increase its costs.

We have now found that the disadvantages of the known processes and apparatus can be alleviated. Thus, we have found that the AC ripple on the rectified current can be effectively cntrolled at a low level, that losses incurred during the reversing of current during processes for the electrodepostion of metals can be reduced significantly, and that the amount of overshoot of the applied current, after current reversal, can be controlled at low values. These results can be attained by using a filter reactor and rectifier means such that the current polarity is reversed in the load and the rectifiers only, while the same current direction is maintained in the filter reactor. We have also found that the use of a filter reactor is essential, not only to control the ripple on the direct current, but also to obtain smooth metal deposits.

SUMMARY OF THE INVENTION

Thus the present invention seeks to provide a process for the electro-deposition of metals wherein the current utilization is increased, whilst using periodic current reversal.

This invention also seeks to provide a process and apparatus for current reversal in the electro-deposition of metals, whereby the time required for achieving the reversal of the polarity of current is decreased.

Additionally, this invention seeks to provide a process and apparatus for current reversal in the electro-deposition of metals, whereby the ripple effect in the DC is reduced, and the overshoot of current after each reversal of current polarity is reduced.

In its broadest scope, there is provided in a process for the electro-deposition of metal a method for effecting periodic reversal of the polarity of the electrical current consisting of passing a controlled direct current between a multiplicity of electrodes, including at least one cathode and at least one anode, immersed in electrolyte in an electrolytic cell, which method comprises:

(i) rectifying a controlled alternating electric current,
(ii) passing the rectified current through a filter reactor,
(iii) passing filtered rectified current to the electro-deposition process and,
(iv) periodically reversing the polarity of the current passing through the electro-deposition process for desired periods of time, the current passing through the filter reactor in the same direction regardless of the polarity of the current passing through the electro-deposition process.

In a specific embodiment there is provided in a method for the electrorefining of lead from lead bullion consisting of passing a controlled direct current between a multiplicity of electrodes including at least one cathode, at least one anode, and at least one electrically unconnected lead bullion bipolar electrode immersed in an aqueous electrolyte containing lead fluosilicate and fluosilicic acid, in an electrolytic cell, which method comprises:

(i) rectifying a controlled alternating electric current,
(ii) passing the rectified current through a filter reactor,
(iii) passing filtered rectified current to the electro-deposition process and,
(iv) periodically reversing the polarity of the current passing through the electro-deposition process for desired periods of time, the current passing through the filter reactor in the same direction regardless of the polarity of the current passing through the electro-deposition process.

Preferably, the current reversal is achieved from full forward current to substantially full reverse current wth a switching time of from five to twenty five milliseconds.

In another embodiment there is provided an apparatus for effecting periodic reversal of the polarity of the electrical current between a forward mode and a reverse mode in a process for the electro-deposition of metal which comprises in combination:

(1) a transformer having a primary winding and at least one secondary winding, said secondary winding having either a common point, or a centretap;
(2) an AC power supply connected to the transformer primary winding;
(3) a pair of primary rectifier means consisting of one forward primary rectifier means and one reverse primary rectifier means each connected to a terminal of the transformer secondary winding;
(4) a filter reactor;
(5) a connection linking the forward primary rectifier means to a first end of the filter reactor;
(6) a connection linking the reverse primary rectifier means to a second end of the filter reactor;
(7) one reverse steering rectifier means connected with the first end of the filter reactor;
(8) one forward steering rectifier means connected with the second end of the filter reactor;
(9) A load comprising an electro-deposition process connected between said common point or centre tap of the transformer secondary winding and both the forward and the reverse steering rectifier means; and
(10) control means adapted to switch and control both the primary rectifier means and the steering rectifier means to cause current to flow through the electro-deposition process in either a forward mode, or in a reverse mode as desired.

The method and apparatus of the invention, which may be used in processes which have a back EMF, are particularly suitable for use in metal electro-deposition processes which have a low back EMF upon reversal of current polarity. Such processes include, for example, those for the electrorefining and electrowinning of copper and lead. The following description of the method and apparatus is with reference to processes having a relatively low back EMF.

The method and apparatus of the invention wll now be described in detail with reference to the accompanying drawings, in which

DESCRIPTION OF THE PREFERRED EMBODIMENTS

Figure 1:
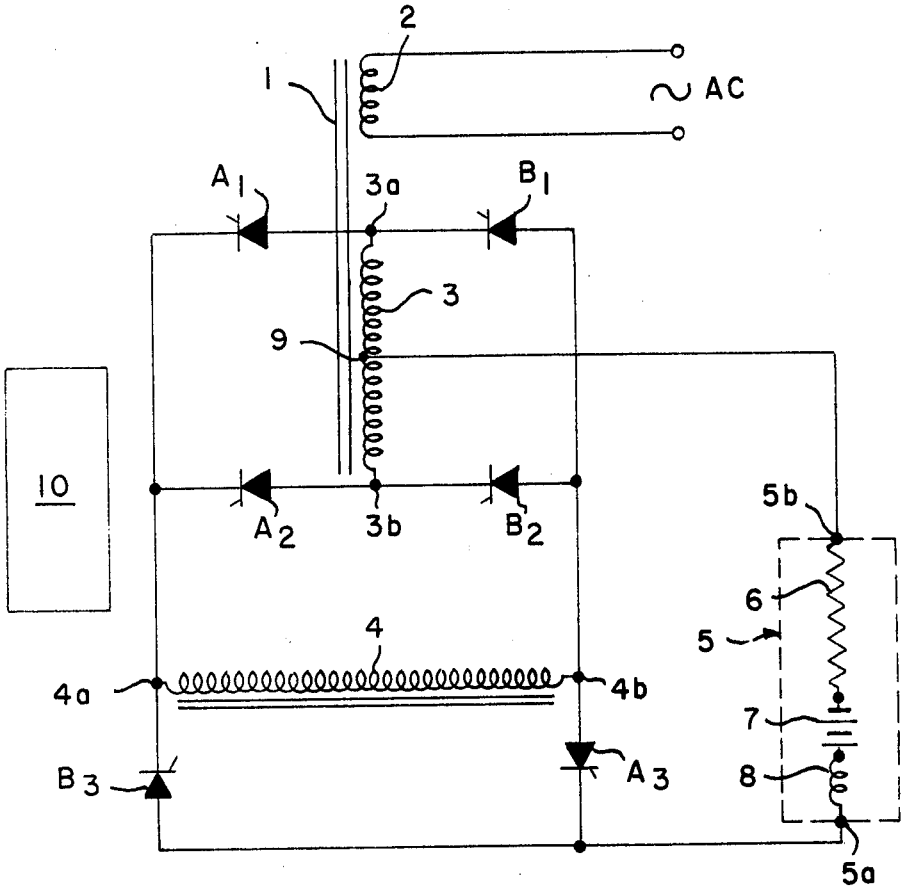
FIG. 1 is a simplified single phase schematic circuit diagram illustrating the principle of the apparatus for effecting current reversal in the electro-deposition of metals.

With reference to FIG. 1, the apparatus comprises a rectifier transformer, generally indicated at 1 with a primary winding 2 and a secondary winding 3. The primary winding 2 is connected to a single phase AC supply. The secondary winding 3 has terminals 3*a* and 3*b*, and a center tap 9. The terminals 3*a* and 3*b* of the secondary winding 3 are connected via forward primary rectifier means $A_1$ and $A_2$, respectively, to a filter reactor 4 at point 4*a* and are also connected via reverse primary rectifier means $B_1$ and $B_2$ respectively, to filter reactor 4 at point 4*b*. The primary rectifier means and the steering rectifier means (to be described) comprise one or more switched or controlled rectifiers. Preferably, the switched or controlled rectifiers are thyristors, such as, for example, silicon controlled rectifiers. Filter reactor 4 is connected via one or the other steering rectifier means $A_3$ or $B_3$ to one side 5*a* of the load, generally indicated at 5, which represents the electrolytic process. The electrolytic process usually comprises a resistance 6, a back EMF 7 and a small but unavoidable inductance 8 shown in series. Point 4*b* of filter reactor 4 is connected with point 5*a* of load 5 via forward steering rectifier means $A_3$ and point 4*a* is connected with point 5*a* of load 5 via reverse steering rectifier means $B_3$. The other side of load 5, from point 5*b*, is connected with centre tap 9 of the secondary winding 3 of transformer 1. The operation of the apparatus is controlled and programmed by means of control means 10, which is connected (not shown) with the AC power supply, the transformer, the filter reactor, the primary rectifier means, the steering rectifier means and the DC output. Control means 10, including the electronic memories, not shown, monitors the operation of the power supply, the power output, the transformer and the rectifier means, and switches or controls the primary rectifier means and the steering rectifier means. Control means 10 also provides for closed-loop control of the current in the electro-deposition process. Control means 10 may also include programming means adapted to vary the current passing through the electro-deposition process according to a desired program.

Figure 2:
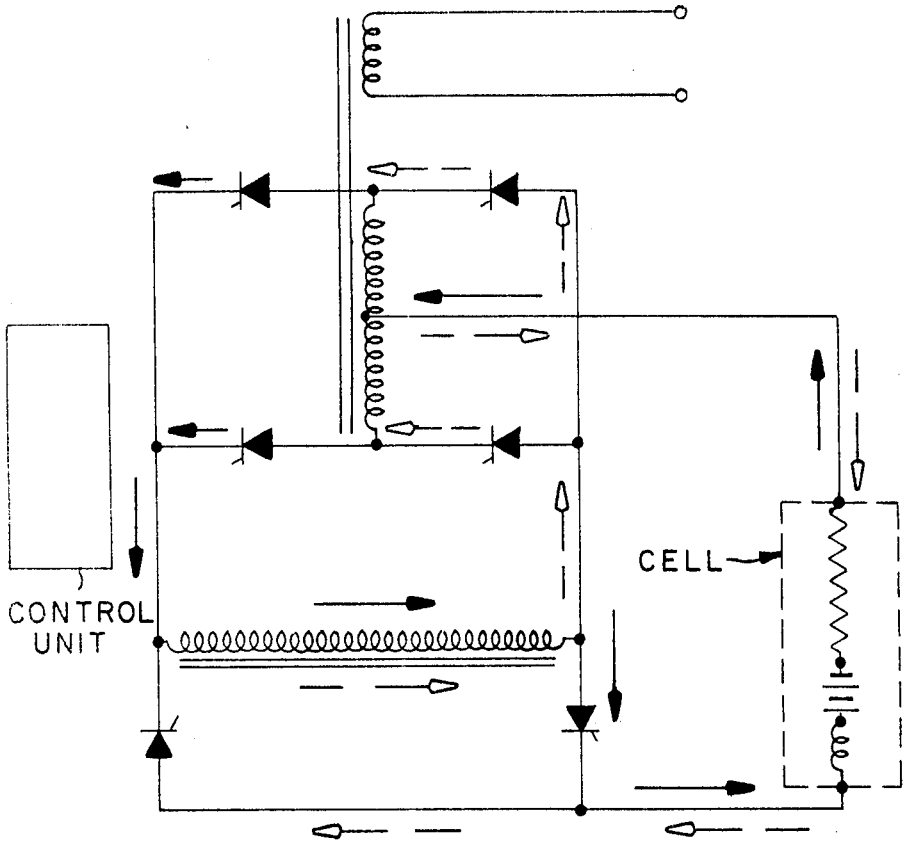
FIG. 2 is a simplified circuit as shown in FIG. 1, indicating the various possible current paths.

In the operation of the apparatus, when the circuit is in the forward mode, forward steering rectifier means $A_3$ conducts continuously and forward primary rectifier means $A_1$ and $A_2$ are phase controlled by control means 10 to give the desired current and voltage levels. The current path is from secondary transformer winding 3 through forward primary rectifier means $A_1$ and $A_2$, filter reactor 4, and forward steering rectifier means $A_3$ to load 5, and returns from load 5 to centre tap 9 of the secondary winding 3 of transformer 1. This is shown schematically by the solid arrows in FIG. 2.

When a reversal is required as ordered by control means 10, reverse steering rectifier means $B_3$ is fired and forward primary rectifier means $A_1$ and $A_2$ are phased back to the limit. This indicates that, at the moment of reversing, forward steering rectifier means $A_3$ and reverse steering rectifier means $B_3$ are both conducting, thus supplying a path for current through filter reactor 4 and effectively making the voltage across the reactor 4 zero. When the firing or phase angle of forward primary rectifier means $A_1$ and $A_2$ is phased back to the limit while reverse steering rectifier means $B_3$ is on, the current through load 5 reduces very rapidly to zero. The reduction to zero would be substantially instantaneous if it were not for the inductance 8.

As soon as the current through the load 5 has stopped, i.e., when both $A_1$ and $A_2$ are switched off, reverse primary rectifier means $B_1$ and $B_2$ are fired. As soon as $B_1$ and $B_2$ fire, forward steering rectifier means $A_3$ is switched off and the system operates in the reverse mode.

With the system in the reverse mode, the current path is from centre tap 9 of transformer secondary winding 3 through load 5, reverse steering rectifier means $B_3$, filter reactor 4 and reverse primary rectifier means $B_1$ and $B_2$ to the terminals 3*a* and 3*b* of secondary transformer winding 3. This is shown schematically by the broken line arrows in FIG. 2.

Upon completion of the desired time for the reverse mode, the control means 10 will command a reversal of current and the process will repeat itself.

One requirement of this procedure is that the direction of the current passing through the filter reactor 4 is the same when the system is in the forward and in the reverse modes. This allows the reversal to take place without having to wait for the current through the filter reactor to decay and to build up in the opposite direction. In control unit 10 are two electronic memories, one to remember the last used firing angle in the forward mode and one to remember the last used firing angle in the reverse mode. Upon reversal, feedback is initiated to the last used firing angle in the related direction, rather than to the firing angle corresponding to zero output. As a result, the feedback system does not have to adjust to any great extend after reversal and any transient phenomena are well controlled.

Figure 3:
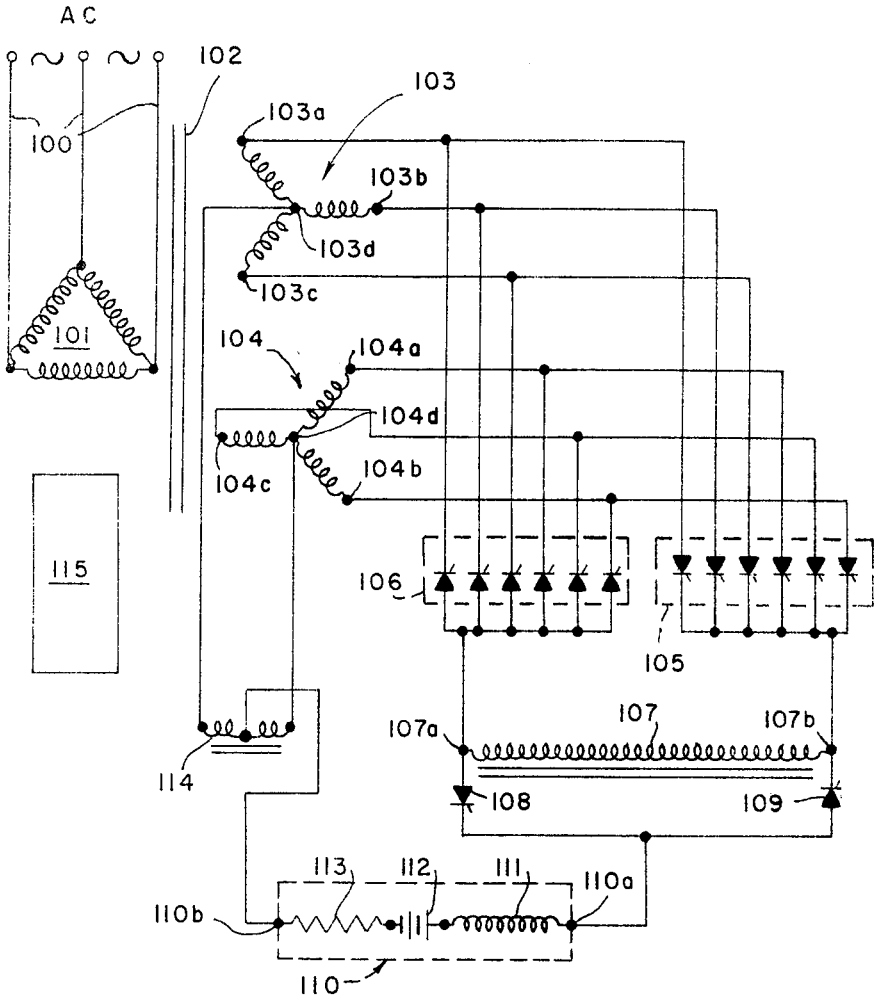
FIG. 3 is a simplified three phase schematic circuit diagram of an apparatus according to the invention.

In FIG. 3, is shown a somewhat simplified circuit diagram for an apparatus using three phase current according to the invention. Three phase AC supply 100 is connected to primary windings 101 of rectifier transformer 102. The primary windings 101 may be protected by fuses or breakers, as desired. The transformer secondary windings are interconnected in a conventional manner through interphase transformer 114. Transformer 102 has two secondary windings 103 and 104, having common points 103*d* and 104*d* , respectively. Each phase from the secondary windings 103 and 104 is connected, from common points 103*d* and 104*d*, via points 103*a*, 103*b* and 103*c* and points 104*a*, 104*b* and 104*c* respectively, with one pole of one of the forward primary rectifier means 105 consisting of six rectifiers and with one pole of the reverse primary rectifier means 106 consisting of six rectifiers. Across the other poles of primary rectifier means 105 and 106, i.e. the connected poles of each group of six rectifiers, are connected a filter reactor 107, a forward steering rectifier means 108 and a reverse steering rectifier means 109. As in the apparatus described with reference to FIG. 1, the primary and steering rectifier means are switched or controlled rectifiers. The rectifiers are preferably thyristors, such as, for example, silicon controlled rectifiers. The steering rectifier means 108 and 109 are connected to one side 110*a* of load 110. The load, which represents the electro-deposition process, can be represented by inductance 111, back EMF 112 and resistance 113 in series. The current path from the other side 110*b* of the load 110 splits through interphase transformer 114 and the split outputs from the interphase transformer 114 are connected to the common points 103*d* and 104*d* of secondary windings 103 and 104, respectively, of rectifier transformer 102. A control means 115, including electronic memories, not shown, is connected in the system with the AC power supply, the transformer, the filter reactor, the primary rectifier means, the steering rectifier means and the DC output. The control means 115 controls and monitors the operation of the system, and provides closed-loop control of the current in the electro-deposition process. Control means 115 may also include programming means adapted to vary the current through the electro-deposition process according to a desired program.

The apparatus according to FIG. 3 is a programmable DC power supply. Even though the DC output of the rectifiers 105 and 106 is filtered by a large filter reactor 107, the current direction can be reversed from full forward current to full reverse current in less than about 12 milliseconds, often in not more than about 5 milliseconds. For one period of reversed current, i.e. current reversal from positive to negative and back to positive, the time required for switching the current from positive to negative and back to positive per se, that is the transition time only, can, therefore be accomplished in the range of about 10 to 25 milliseconds, or less. As pointed out above, this is accomplished by maintaining the current through the filter reactor 107 in the same direction regardless of whether the rectifiers are delivering forward or reverse current, and thus regardless of the current direction through the electro-deposition process. Thus again, time delays to allow the current in the filter reactor 107 to fall to zero are completely avoided.

The twelve primary rectifier means 105 and 106 together with the two large steering rectifier means 108 and 109 act as steering devices to ensure that the current flows through filter reactor 107 in the same direction. During the reversing of the current, filter reactor 107 is shorted by the two steering rectifier means 108 and 109, and the current in the filter reactor 107 moves freely through these two steering rectifier means. During switching, the current in the filter reactor 107 drops only very slightly.

Preferably, the filter reactor 107 is a saturating core-type filter, i.e., the filter reactor has a high inductance at low currents and a low inductance at high currents. This is important when the electro-deposition process is to be supplied with varying currents, or with a programmed current, which, for example, is decreased during the deposition process, such as for example in the electrorefining of lead. By choosing this type of filter reactor, the weight of the filter reactor is relatively low compared to other types of filter reactors. Moreover, the current feedback loop stabilization is simplified for a wide range of values of the current load.

The rating of filter reactor 107 should be such that the DC ripple is effectively controlled at a low current level. If desired, the rating of the filter reactor 107 and the output voltage of the transformer 102 can both be changed by one or more convenient voltage taps (not shown). Secondary taps on the transformer would allow operation at low output voltages without incurring very poor power factors. Any tap on the filter reactor would allow adjustment of the ripple effect on the direct current, if so desired.

Each of the forward and reverse primary rectifier means 105 and 106 is protected by a conventional surge suppressor (not shown). The surge suppressor reduces high voltage spikes, limits the rise of voltage across the primary rectifier means and thereby prevents accidental firing of these rectifier means. Suitable fast fuses, also not shown can be interposed between the primary rectifier means and the transformer secondary windings 103 and 104.

The apparatus can be used in electro-deposition processes for metals which have a back EMF. Processes such as, for example, the electrorefining of lead and copper have a relatively low back EMF, while a process such as, for example, the electrowinning of zinc has a relatively high back EMF. In the latter case, the inclusion of a DC breaker between rectifiers and load is desirable to prevent the rectifiers from shortcircuiting the cell back EMF when AC power failures occur while the system is operating in the regenerative mode.

In the operation of the apparatus, AC is supplied to the primary windings 101 of the transformer 102. The alternating current is transformed in transformer 102 and passes through secondary windings 103 and 104, and through the forward and reverse primary rectifier means 105 and 106. When the system is in the forward mode, the current path is through the forward primary rectifier means 105 and then through the filter reactor 107 (going from right to left in the figure), then through the forward steering rectifier means 108, and through load 110. After the current has gone through the load, the current path splits two ways through the interphase transformer 114 and returns to the common points 103*d* and 104*d* of the three phase secondary windings 103 and 104, respectively, of transformer 102. When the rectifier is operating in the reverse mode, as commanded by control means 115, the current path is through load 110, through the reverse steering rectifier means 109, through the filter reactor 107 (again from right to left in the figure), and to the reverse primary rectifier means 106. The current subsequently passes through the two transformer secondary windings 103 and 104 connected to the reverse primary rectifier means 106 and reunites after passing through the interphase transformer 114. The current path is then back to load 110. In control unit 115, there are two electronic memories, one to remember the last used firing angle in the forward mode and one to remember the last used firing angle in the reverse mode. Upon reversal, feedback is initiated to the last used firing angle in the related direction, rather than to the firing angle corresponding to zero output. As a result, the feedback system does not have to adjust to any great extent after reversal and any transient phenomena are well controlled.

Figure 4:
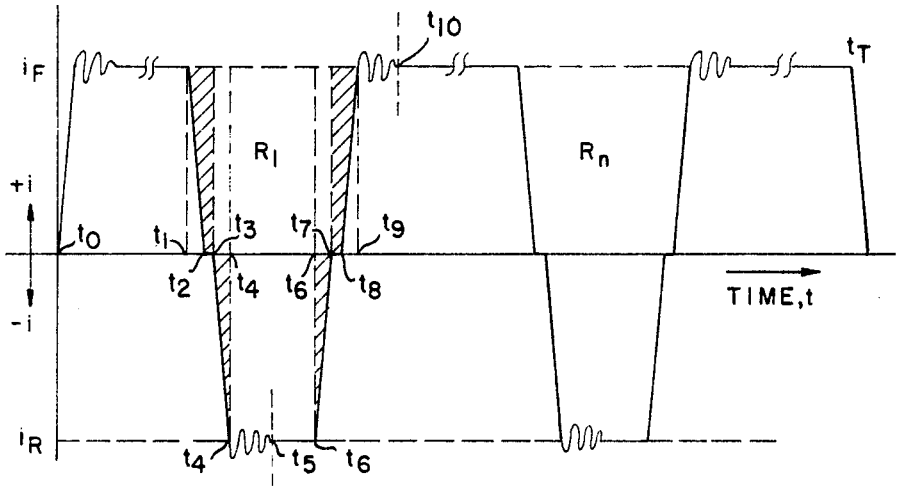
FIG. 4 is a current-time diagram illustrating the current-time relationship for an electro-deposition cycle of a metal.

The schematic current-time diagram of FIG. 4 illustrates the current-time relationship for an electrodeposition cycle of a metal. The diagram is not drawn to scale. The control unit switches on a forward current $i_F$ at the beginning of the electro-deposition cycle at time $t_o$. At the end of the predetermined period for electro-deposition of metal at time $t_1$, the forward current is switched off and the current decays to zero at time $t_2$. After the current has decayed to zero, the polarity of the current is reversed at time $t_3$ to the value of the reverse current $i_R$, which is reached at time $t_4$. The actual value of the reverse current is somewhat lower than the predetermined value of the reverse current $i_R$. The overshoot to a current more negative than $i_R$ decays rapidly from time $t_4$ to time $t_5$ at which time the reverse current $i_R$ will prevail until the end of the predetermined period of reversal at time $t_6$. At time $t_6$ the current $i_R$ is switched off and the current decays to zero at time $t_7$. After the load current has decayed to zero, the polarity of the current is reversed at time $t_8$ to the value of the forward current $i_F$, which is reached at time $t_9$. The value of $i_F$ is somewhat exceeded but the current overshoot decays rapidly to the predetermined value of $i_F$ at time $t_{10}$. This completes one reversal cycle which is indicated as $R_1$, taking the time span $t_1$ to $t_9$ to complete.

The reversals of current repeat themselves according to the commands from the control unit for the duration of the electro-deposition cycle which ends at time $t_T$, at which time the current to the process is interrupted. The time $t_T$ represents the total time for the electro-deposition cycle. The last reversal $R_n$ is shown in the diagram, n being the number of reversals during the electro-deposition cycle.

The shaded trapezoid areas indicated in reversal $R_1$ between points $t_2$ and $t_3$, and $t_7$ and $t_8$, and the value of $i_F$ and the shaded triangular areas indicated in reversal $R_1$ between $t_3$ and $t_4$, and $t_6$ and $t_7$, and the value of $i_R$ multiplied by the number of reversals "n" during the electro-deposition cycle approximately represent the loss of current utilization (C.U.) due to switching the polarity of the current.

The trapezoid area between points $t_3$ and $t_7$ and the value of $i_R$ approximately represents one half of the loss in C.U. due to dissolution of deposited metal, the other half being an equivalent area (not shown) which forms part of the deposition period and which is required to re-deposit the dissolved metal.

In a given electro-deposition process, the values of the forward and reverse currents may be the same or may be different. Preferably, the values of $i_F$ and $i_R$ are essentially the same, as shown in FIG. 4. The duration of the period of reverse current flow is usually a fraction of the period of forward current flow. It is noted that when the current is switched on at time $t_o$, the value of $i_F$ is subject to an overshoot and when the current is switched off at time $t_T$, the current decays to zero.

The period of metal deposition during one deposition cycle is represented by the time $t_1$ (plus a fraction related to time $t_2-t_1$, and minus a fraction related to the switching on of the current) and that of metal dissolution by $t_6-t_4$ (plus fractions related to times $t_4-t_3$ and $t_7-t_8$). The current decay and current build up periods prior to and after the reversing of the current polarity ($t_{FS}$ and $t_{RS}$ in the above equation) are represented by $t_2-t_1$ and $t_7-t_6$, and by $t_4-t_3$ and $t_9-t_8$, respectively. The quiescent or "dead" times $t_D$ are represented by $t_3-t_2$ and by $t_8-t_7$. The overshoot periods are represented by $t_5-t_4$ and $t_9-t_{10}$. The switching times $t_S$ are represented by $t_4-t_1$ and $t_9-t_6$, thus $t_s=t_{FS}+t_D+t_{RS}$.

The apparatus of this invention permits minimizing each of these time periods.

An apparatus was built according to the invertion as described with reference to FIG. 3 which provided a programmable DC power supply with a rating of 1800 A and 100 V. This apparatus was capable of attaining switching times ($t_4-t_1$ and $t_9-t_6$) in the range of about 5 ms to 25 ms with current build up and decay times of less than about 5 ms. The ripple (measured between half peaks and related to the mean current value) could be controlled in the range of about 5 to 30% and the overshoot in the range from 50% to as low as about 5% of the values of the forward and reverse currents. Usually, dead times were about 5 ms or less, build up and decay times were typically less than about 3 ms and usaully about 0.5 ms each, and switching times were 12 ms or less. Depending on the voltage tap used on the filter reactor and the back EMF of the electrodeposition process, overshoot and ripple were about 5 to 7%. When operating at a low process voltage from a high voltage tap on the filter reactor, the ripple was in the range of about 10 to 13% and the overshoot in the range of about 20 to 35%.

The method and apparatus of the invention have a number of important advantages. Very fast current reversals are obtained with switching times between full forward current and full reverse current which are significantly smaller than those obtainable with known methods and equipment using conventional line frequencies. Very little overshoot of current upon reversal of the current polarity is experienced because the system is initiated in the forward mode and in the reverse mode with all of the variables of the control system at their steady state levels. The system is easily stabilized for varying current loads because response time is no longer a problem. The ripple on the rectified current is effectively controlled at low values. Possible damage to the primary rectifiers due to cross-fire between primary forward and reverse rectifiers is eliminated because the filter reactor effectively limits the current.

The rectifiers do not require excess voltage capacity as a rapid decay and build-up of inductor current is no longer required. This improves the power factor of the system and allows greater safety margins on rectifier means voltages at no additional cost.

The invention will now be illustrated by the following non-limitative examples.

The apparatus for applying periodic current reversal was a 1800 A, 100 V programmable DC power supply, 600 V, 60 cycle, three phase AC power was supplied to the transformer, each phase protected by a 250 A fuse. The transformer had a primary of 600 V-60 Hz-3 phase, delta connected and two secondaries of six legs in two "Y" connected sets, rated 95 V-600 A per leg.

The current outputs from the transformer contained 1000 A fast fuses. All rectifier means were silicon controlled rectifiers. The forward and reverse primary rectifiers has a rating of 600 V at 1000 A. The steering rectifiers had a rating of 2200 A at 500 V. The filter reactor had a rating of 1000 μh at 120 A, 530 μh at 500 A, 290 μh at 1000 A, and 46 μh at 2000 A. The interphase transformer had a rating of 1000 A per phase; 0.3 volt seconds per half cycle across both halves of the winding together.

The periodic current reversal capability was a reversal frequency in the range of 0 to 100 reversing cycles per minute and a reverse pulse width adjustable between 0.005 and 1.0 second.

EXAMPLE 1

The apparatus was used for applying periodic current reversal in the bipolar refining of lead. A rectified current of 940 A at 10 V was supplied to one of the end electrodes of a number of bipolar lead bullion electrodes in an electrolytic cell. The surface area of one face of the electrodes was 2.2 $m^2$. The electrode current density was 376 $A/m^2$. Electrolyte containing 100 g/L lead as lead fluosilicate, 70 g/L fluosilicic acid and the required amounts of addition agents, to assure proper metal deposits, was circulated through the cell.

The use of a programmed current at maximum allowable values in relation to the resistance of the slimes layer on the anodic side of the electrodes, whereby the anodic overvoltage at no time exceeds the critical value at which impurities dissolve (200 mV), resulted in a refining cycle of 96 hours. The current at the end of the refining cycle was 480 A. The electrode current density was 192 $A/m^2$. During the electrolysis, the current was reversed for periods of 150 ms with a frequency of 18 reversals per minute for a total time for the reversed current of 4.5% of the duration of the refining cycle. The values of the forward current and the reverse current were the same. The current efficiency was 88%. The current-time relationship was monitored and recorded with the use of an oscilloscope. The record shows that the switching times from full forward to full reverse current and including dead time and the build up and the decay times were 6 ms each. The ripple on the DC was 11% of the value of the current. The current overshoot was 33% of the value of the forward current (and the reverse current) at the beginning of the refining cycle (current density 376 $A/m^2$) and decreased to 25% at the end of the refining cycle (current density 192 $A/m^2$). The current overshoot decayed to zero in 150 ms.

The current utilization was calculated to be 90.7%, using the equation given hereinabove.

If the switching times were longer such as, for example, 30 ms or 100 ms, attainable with apparatus known in the art, the current utilization would be 89.2% or 85% respectively.

Example 2

The test described in Example 1 was repeated in the bipolar refining of lead but with electrodes having a 4 $m^2$ surface. A current of 1680 A at 42 V was supplied to one of the end electrodes of a number of bipolar lead bullion electrodes in an electrolytic cell. The electrode current density was 380 $A/m^2$. Electrolyte containing 100 g/L lead as lead fluosilicate, 70 g/L fluosilicic acid and the required amounts of addition agents, to assure proper metal deposits, was circulated through the cell.

The use of a programmed current at maximum allowable values in relation to the resistance of the slimes layer on the anodic side of the electrodes, wereby the anodic overvoltage at no time exceeds the critical value at which impurities dissolve 200 mV), resulted in a refining cycle of 96 hours. The current at the end of the refining cycle was 900 A. The electrode current density was 205 $A/m^2$. During the electrolysis, the current was reversed for periods of 150 ms with a frequency of 18 reversals per minute for a total time for the reversed current of 4.5% of the duration of the refining cycle. The values of the forward current and the reverse current were the same. The current efficiency was 90%. The current-time relationship was monitored and recorded with the use of an oscilloscope. The record shows that the switching times from full forward to full reverse current were 12 ms each (the build-up and decay times were 4 ms each). The ripple on the DC was 5% of the value of the current. The current overshoot was 32% of the value of the forward current (and the reverse current) at the beginning of the refining cycle and was 36% at the end of the refining cycle. The current overshoot decayed to zero in 100 ms. The current utilization was calculated to be 90.3%, using the equation given hereinabove.

EXAMPLE 3

The test of Example 1 was repeated but the filter reactor was essentially by-passed by changing voltage taps on the filter reactor for minimum inductance.

The resulting switching time was substantially the same as the one in Example 1, but the current ripple varied between 22% at the beginning of the refining cycle and 50% at the end of the refining cycle, while the current overshoot varied between 39% and 83%. The high ripple and overshoot resulted in considerable extraneous lead growths which resulted in turn in extensive electrical shorting between the electrodes. The current efficiency was only 42%.

The results show that the use of a filter reactor is necessary not only to reduce current ripple and overshoot but also to obtain smooth deposits and thereby control shorting in the electro-deposition process.

It will be understood of course that modifications can be made in the embodiments of the invention illustrated and described herein without departing from the scope and purview of the invention as defined by the appended claims. For example, when using three phase current, the transformer may have a single secondary winding having a common point, and no interphase transformer is used. The number of primary rectifier means consist then of three forward and three reverse primary rectifiers.

What we claim as our invention is:

1. A method for effecting periodic reversal of the polarity of the electrical current in a process for the electro-deposition of a metal, consisting of passing a controlled direct current between a multiplicity of electrodes including at least one cathode and at least one anode, immersed in an electrolyte in an electrolytic cell, which method comprises:

(i) rectifying an alternating electric current by passing the alternating current through rectifier means;

(ii) filtering the rectified current by passing it through a filter reactor;

(iii) passing the filtered rectified current to the electro-deposition process;

(iv) controlling the polarity of the current provided by the rectifier means to the electro-deposition process by a control means; and (v) periodically ordering the control means to reverse the polarity of the current passing through the electro-deposition process for desired periods of time without changing the polarity of the current passing through the filter reactor.

2. A method for the electro-refining of lead from lead bullion consisting of passing a controlled direct current between a multiplicity of electrodes, including at least one cathode, at least one anode, and at least one electrically unconnected lead bullion bipolar electrode, immersed in an aqueous electrolyte containing lead fluosilicate and fluosilicic acid, in an electrolytic cell, which method comprises:

(i) rectifying an alternating electric current by passing the alternating current through rectifier means;
(ii) filtering the rectified current by passing it through a filter reactor;
(iii) passing the filtered rectified current to the electro-deposition process;
(iv) controlling the polarity of the current provided by the rectifier means to the electro-deposition process by a control means; and
(v) periodically ordering the control means to reverse the polarity of the current passing through the electro-deposition process for desired periods of time without changing the polarity of the current passing through the filter reactor.

3. A method for the electro-deposition of a metal by means of an electrolytic cell, to which cell is applied a controlled direct current which current is subject to periodic current reversal, the improvement comprising passing the current used in the cell through a filter reactor in one direction only.

4. In an apparatus comprising an electrical circuit for supplying a controlled direct electric current to a cell for the electro-deposition of a metal, including means to rectify an alternating current and means to effect current reversal, the improvement comprising including in the electrical circuit a filter reactor through which the direct electric current passes in one direction only.

5. A method according to claim 1, 2 or 3, wherein the current polarity reversal from full forward current to full reverse current is effected in a time in the range of from about 5 to about 25 milliseconds.

6. A method according to claim 1, 2 or 3, wherein the DC ripple is controlled by selecting an appropriate rating for the filter reactor and selecting an appropriate transformer output voltage.

7. An apparatus for effecting periodic reversal of the polarity of the electrical current between a forward mode and a reverse mode in a process for the electro-deposition of a metal which comprises in combination:

(1) a transformer having a primary winding and at least one secondary winding said secondary winding having either a common point or a centre tap;
(2) an AC power supply connected to the transformer primary winding;
(3) a pair of primary rectifier means consisting of one forward primary rectifier means and one reverse primary rectifier means each connected to a terminal of the transformer secondary winding;
(4) a filter reactor;
(5) a connection linking the forward primary rectifier means to a first end of the filter reactor;
(6) a connection linking the reverse primary rectifier means to a second end of the filter reactor;
(7) one reverse steering rectifier means connected with the first end of the filter reactor;
(8) one forward steering rectifier means connected with the second end of the filter reactor;
(9) a load comprising an electro-deposition, process, connected between said common point or centre tap of the transformer secondary winding and both the forward steering rectifier means and the reverse steering rectifier means; and
(10) control means adapted to switch and control both the primary rectifier means and the steering rectifier means to cause current to flow through the electro-deposition process in either a forward mode or in a reverse mode as desired.

8. Apparatus according to claim 7 wherein the primary rectifier means connected to the transformer secondary winding are thyristors.

9. Apparatus according to claim 7, wherein the steering rectifier means are thyristors.

10. Apparatus according to claim 8 or 9, wherein the thyristors are silicon controlled rectifiers.

11. Apparatus according to claim 7, wherein the AC power supply is single phase, and the transformer has a secondary winding having a centre tap.

12. Apparatus according to claim 7, wherein the AC power supply is three phase, the transformer has two Y-connected secondary windings, each having a common point, and the two common points and the electro-deposition process are connected through an interphase transformer.

13. Apparatus according to claim 7, 8, or 11, wherein each terminal of the secondary winding is connected with a foward primary rectifier and a reverse primary rectifier.

14. Apparatus according to claim 7, 8, or 9, wherein the AC power supply is three phase, the transformer has one Y-connected secondary winding having a common point, and wherein each terminal of the secondary winding is connected with a forward primary rectifier and a reverse primary rectifier.

15. Apparatus according to claim 7, 11, or 12, wherein the control means includes programming means adapted to effect periodic current reversal according to a desired time cycle.

16. Apparatus according to claim 7, 11 or 12, wherein the control means includes programming means adapted to vary the current passing through the electro-deposition process according to a desired program.

17. Apparatus according to claim 7, wherein the filter reactor is a saturating core-type filter having high inductance at low currents, and low inductance at high currents.

18. Apparatus according to claim 7, or 17, wherein the filter reactor is provided with a plurality of voltage taps.

* * * * *